United States Patent [19]

Freed, Jr.

[11] 4,296,856

[45] Oct. 27, 1981

[54] MATERIAL GATHERING DEVICE FOR A MINING MACHINE

[75] Inventor: Donald L. Freed, Jr., Belleville, Ill.

[73] Assignee: National Mine Service Company, Pittsburgh, Pa.

[21] Appl. No.: 109,333

[22] Filed: Jan. 3, 1980

[51] Int. Cl.[3] ..... B65G 65/02

[52] U.S. Cl. ..... 198/514; 198/522

[58] Field of Search ..... 198/512–516, 198/522, 308; 299/43–45, 64–67

[56] References Cited

U.S. PATENT DOCUMENTS

| | | | |
|---|---|---|---|
| 2,753,971 | 7/1956 | Ball | 198/514 |
| 3,417,851 | 12/1968 | Gonski et al. | 198/308 |
| 3,620,345 | 11/1971 | Gonski | 198/516 |
| 3,680,920 | 8/1972 | Amoroso | 198/522 |
| 4,056,189 | 11/1977 | Freed | 198/514 |

FOREIGN PATENT DOCUMENTS

| | | | |
|---|---|---|---|
| 618566 | 1/1977 | U.S.S.R. | 198/513 |

*Primary Examiner*—Joseph E. Valenza

*Attorney, Agent, or Firm*—Stanley J. Price, Jr.; John M. Adams

[57] ABSTRACT

A mining machine includes a mobile body and an endless conveyor for conveying rearwardly on the body the material dislodged by the mining machine. A gathering platform extends forwardly from the conveyor. Oscillating gathering arms positioned laterally of the receiving end of the conveyor on the gathering platform feed the dislodged material rearwardly on the gathering platform. A plow-like forward edge portion extends transversely across the front of the gathering platform and opposite side portions extend rearwardly from the forward edge portion. Deflector plates are pivotally mounted on the gathering platform adjacent the opposite side portions at the gathering platform forward edge portion to deflect the loose material deposited on the mine floor along the mine wall onto the gathering platform. The deflector plates are biased laterally outwardly from the forward edge portion toward stops mounted on the gathering platform which limit their outward pivotal movement.

9 Claims, 7 Drawing Figures

MATERIAL GATHERING DEVICE FOR A MINING MACHINE

BACKGROUND OF THE INVENTION

1. Field of the Invention

This invention relates to a material gathering device for a mining machine and more particularly to a gathering platform having pivotal means extending laterally from the side portions of the gathering platform for gathering up the loose material deposited on the mine floor adjacent the mine wall.

2. Description of the Prior Art

Continuous mining machines, as illustrated in U.S. Pat. No. 3,774,969, are utilized in underground mining operations to continuously dislodge solid material from the face of a mine shaft. A boom member extends forwardly from an elongated body portion of the mining machine that is propelled through the mine on endless crawler tracks. The boom member is pivotally connected to the mining machine body portion and rotatably supports a cutter drum assembly having peripherally extending cutting elements. The cutter assembly extends transversely to the longitudinal axis of the body portion and upon rotation the cutting elements dislodges solid material from the mine face.

The cutter drum assembly is raised to a preselected vertical height in the mine as determined by the thickness of the coal seam. The cutter drum assembly is rotated and sumped into the mine face with the cutter drum assembly positioned adjacent the mine roof. Once the cutter drum assembly has advanced into the mine face, the boom member is pivoted downwardly to move the cutter drum assembly vertically downwardly through the face to make a shear cut in the face. The gathering device extends forwardly from the mining machine body portion and is positioned rearwardly of the cutter drum assembly. The dislodged material is gathered by the gathering device and fed rearwardly on the gathering device to an endless conveyor that extends the length of the mining machine. The conveyor transports the dislodged material to the rear of the mining machine where it is transferred to another suitable material hauling device such as a shuttle car or another endless conveyor for transporting the material out of the mine. By dislodging material from the mine face as the continuous mining machine advances forwardly in the mine, a mine passageway or room is formed. The mine walls or ribs extend rearwardly from the mine face. The walls are substantially parallel to one another spaced a distance apart determined by the cutting width of the cutter drum assembly. The gathering device includes a gathering platform having either gathering arms positioned on the platform oppositely of the receiving end of the conveyor or counterrotating gathering discs, similarly positioned for directing the dislodged material deposited rearwardly of the cutter drum assembly onto the gathering platform and therefrom onto the conveyor. Thus as the continuous mining machine forwardly advances to dislodge material from the mine face the rotating gathering arms or gathering discs direct the dislodged material to the receiving end of the conveyor as it is fed onto the gathering platform.

A problem is encountered in the gathering of loose material that is deposited on the mine floor adjacent the mine ribs or walls. Generally the width of the cutter drum assembly is greater than the width of the transverse front edge of the gathering platform so as to permit the mining machine to advance through the mine without the gathering platform contacting the mine ribs. Consequently, material dislodged from the mine face by the end portions of the cutter drum assembly adjacent the mine ribs is beyond the gathering limits of the gathering device.

U.S. Pat. No. 4,076,316 discloses a gathering device which is manuevered into a position abutting the mine rib to permit the gathering device side edge portion to pick up the loose material adjacent the rib. This is accomplished by laterally moving the cutter drum assembly relative to the mining machine so that one of the side edges of the gathering device is positioned in abutting relation with the mine rib.

As illustrated in U.S. Pat. No. 4,056,189 the gathering platform has a transverse front edge portion that tapers rearwardly toward the receiving end of the conveyor so as to provide for a continuous flow of dislodged material onto the gathering platform into the path of the gathering arms or discs. At the lateral ends of the forward transverse edge portion, plate members extend laterally and outwardly from the sides of the gathering platform. The plate members are fixed a preselected distance apart thereby forming the lateral limits of the gathering device. The vertical plates or sideboards are angled outwardly toward the mine ribs and serve to deflect the material at the side edges of the gathering platform onto the upper gathering surface of the platform into the path of the gathering devices on the platform. However, because the vertical sideboards are fixed at the side edges of the gathering platform material deposited on the mine floor beyond the gathering limits of the sideboards is not directed onto the gathering platform. Consequently, the uncollected dislodged material may become jammed between the sideboards and the mine ribs, requiring the dislodging operation to be interrupted to clear the jam.

U.S. Pat. No. 3,417,851 discloses a loading head for a mining machine that includes sideboards or wings that extend from each side of the forward transverse edge portion of the gathering platform. The wings are pivotally mounted on the gathering platform. Piston cylinder assemblies mounted on the gathering platform and connected to the wings are operable to pivot the wings to a preselected extended position relative to the gathering platform. In this manner the position of the wings can be adjusted relative to the width of the mine entry.

The wings include flat bottom plates which are movable over the gathering discs wherein the piston cylinder assemblies are operated to move the wings inwardly on the gathering platform. In this manner the wings may be moved to a preselected fixed position by control of the piston cylinder assemblies to provide for an expanded loading width or a restricted loading width.

While it has been suggested by the prior art devices to vary the width of the conveyor platform and to position a conveyor platform of a fixed width adjacent the mine rib for gathering up the loose material adjacent the mine rib, none of the known devices provide a gathering platform having side edges which are maintained closely adjacent or in contact with the mine ribs without becoming jammed or damaged if the side edges should encounter an obstruction at the mine ribs. The known devices do not permit the gathering platform to by pass an obstruction at the mine ribs without incurring damage to the side edges.

Therefore, there is need to provide a gathering device for a continuous mining machine in which the side edge portions are maintained in a position relative to the mine wall to direct the loose material on the mine floor at the mine wall onto the gathering platform as the mining machine advances through the mine. The side edge portions must be freely pivotal on the gathering platform to prevent the side edge portions from becoming jammed against the mine walls and damaged.

SUMMARY OF THE INVENTION

In accordance with the present invention there is provided a material gathering device for a mining machine that includes a gathering platform that extends forwardly from the mining machine for slidable engagment with the mine floor. The gathering platform has a forward edge portion and opposite side portions extending rearwardly from the forward edge portion. Deflector means are provided for deflecting loose material deposited on the mine floor adjacent the forward edge portion and the opposite side portions onto the gathering platform. Means are provided for pivotally mounting the deflector means on the gathering platform adjacent the opposite side portions. The deflector means have an upstanding wall portion adapted to be positioned closely adjacent the mine wall and a material receiving surface extending from the upstanding wall portion toward the respective opposite side portion of the gathering platform. Resilient means extend between the gathering platform and the deflector means for urging the deflector means upstanding wall portion to a position to deflect the loose material located on the mine floor at the mine wall onto the material receiving surface for movement therefrom onto the gathering platform. The resilient means is operable to maintain the upstanding wall portion in a position relative to the mine wall to direct the loose material on the mine floor at the mine wall onto the gathering platform as the mining machine advances through the mine.

The resilient means, which is preferably a compression spring, includes a first end portion abutting the gathering platform. The gathering platform is maintained in a fixed position abutting the resilient means first end portion. The resilient means includes a second end portion which is maintained in abutting relation with the pivotal deflector means. The resilient means is placed in a compressed state between the fixed gathering platform and the pivotal deflector means to urge the deflector means to pivot outwardly on the gathering platform and maintain the upstanding wall portion in contact with the mine wall for gathering up loose material on the mine floor along the mine wall.

The resilient means is also operable to extend and retract between the gathering platform and the deflector means. In this manner the resilient means maintains an outward force on the deflector means to position the upstanding wall portion closely adjacent the mine wall for directing loose material deposited on the mine floor adjacent the mine wall onto the material receiving surface. In this manner the upstanding wall portions of the deflector means provided on each side of the gathering platform can follow the contour of the mine wall and respond to the irregular surface of the mine wall by moving inwardly and outwardly in response to the retraction and expansion of the resilient means. In this manner the deflector means are effective to efficiently gather the loose material adjacent the mine walls and feed the loose material onto the gathering platform.

A stop plate is secured to the gathering platform opposite the side portions adjacent the forward edge portion of the gathering platform. The deflector means include a ground engaging portion which is positioned in spaced underlying relation with the material receiving surface of the deflector means. The ground engaging portion is adapted to slidably support the deflector means on the mine floor. The ground engaging portion has an abutment surface positioned oppositely of the stop plate. The stop plate extends upwardly past the abutment surface into the space between the ground engaging portion and the material receiving surface.

The abutment surface is movable into and out of abutting relation with the stop plate to permit the deflector means to pivot freely between a retracted position and an extended position. The deflector means in the extended position is restrained from further outward pivotal movement by contact of the abutment surface with the stop plate. When the deflector means is in the fully extended position, the resilient means is in an uncompressed state. When the deflector means is in a retracted position, the resilient means is in a compressed state and applies an outward force upon the deflector means to maintain the deflector means in a position to gather up the loose material at the mine wall.

Accordingly, the principal object of the present invention is to provide for a continuous mining machine a material gathering device that efficiently gathers up the loose material deposited on the mine floor adjacent the mine wall.

Another object of the present invention is to provide a material gathering device for a mining machine in which the side edges of the material gathering device are laterally movable and maintained in a position for gathering up the loose material at the mine wall as the mining machine advances through the mine entry without damaging the side edges by being jammed against the mine walls.

These and other objects of the present invention will be more completely described and disclosed in the following specification, the accompanying drawings, and the appended claims.

DESCRIPTION OF THE PREFERRED EMBODIMENT

Figure 1:
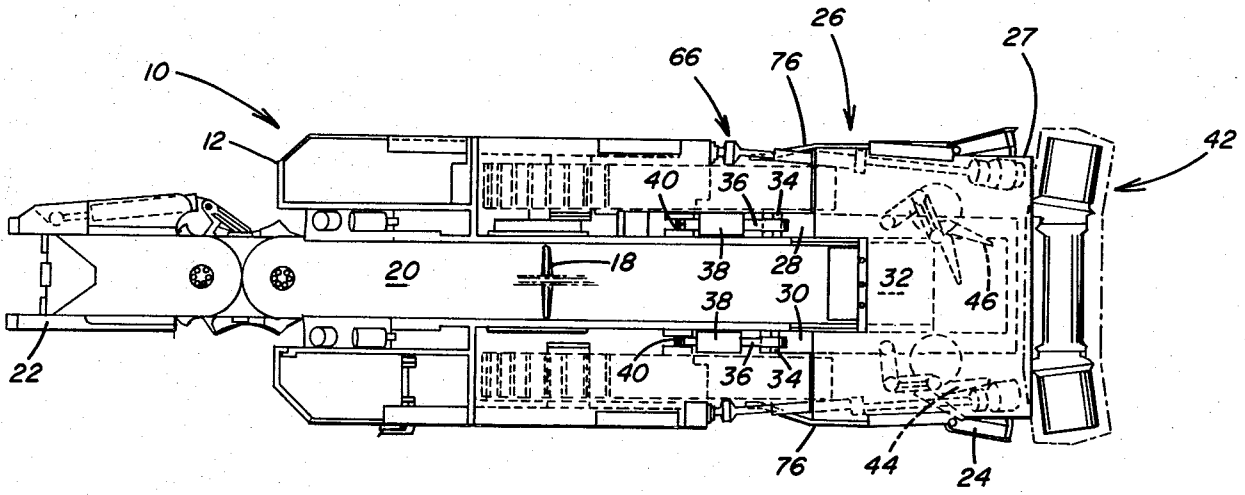
FIG. 1 is a top plan view of a continuous mining machine, illustrating a cutter drum assembly extending forwardly from the mining machine body portion with a gathering device positioned rearwardly of the cutting drum assembly for gathering loose material dislodged by the cutter drum assembly.
Figure 2:
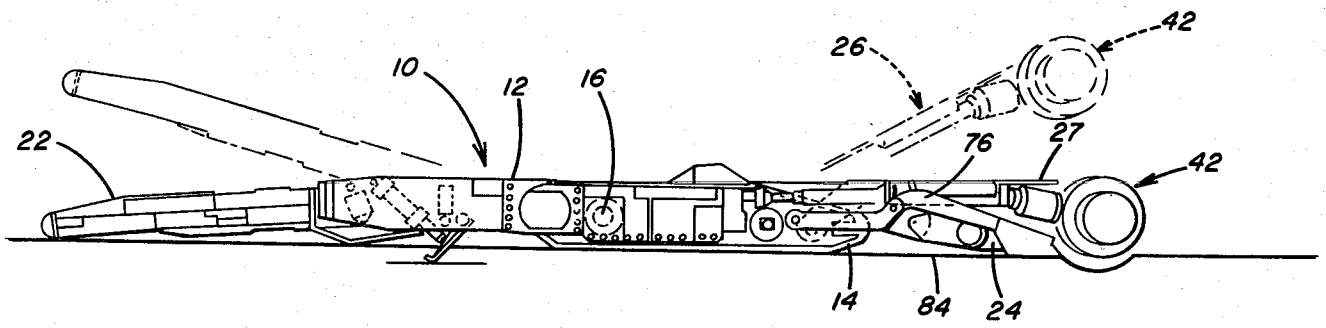
FIG. 2 is a view in side elevation of a continuous mining machine shown in FIG. 1, illustrating the gathering device positioned for slidable movement on the mine floor rearwardly of the cutter drum assembly.

Referring to the drawings and particularly to FIGS. 1 and 2 there is illustrated a continuous mining machine generally designated by the numeral 10 that has a body or frame portion 12 suitably mounted on endless crawler tracks 14. Electric motors 16 are provided to propel the mining machine 10 on the endless crawler tracks 14 to advance the mining machine in the mine during the mining operation of dislodging solid material from the mine face. An endless conveyor mechanism 18 is positioned in a longitudinal trough member 20 and conveys dislodged material therein from the front of the mining machine to an articulated rear discharge section 22.

As illustrated in FIG. 2, a gathering device generally designated by the numeral 24 extends forwardly from the body portion 12 and is arranged to gather and feed the dislodged material onto the conveyor trough 20 so that the dislodged material can be conveyed rearwardly by the endless conveyor mechanism 18 to the discharge section 22. From the discharge section 22 the loose material is transferred to another suitable material haulage device for transporting the loose material out of the mine.

A boom member generally designated by the numeral 26 extends forwardly from the body portion 12 and a cover plate 27 extends from the receiving end portion of the conveyor mechanism 18 forwardly therefrom into overlying relation with the front of the gathering device 24. The boom member 26 includes a pair of parallel rearwardly extending arm members 28 and 30 and are connected at their forward end portions to a housing 32 that extends transversely across the front of the mining machine 10.

Each of the arm members 28 and 30 are pivotally connected at a pivot point 34 to a piston rod 36 of a piston cylinder assembly 38. The pair of piston cylinder assemblies 38 are, in turn, pivotally connected to the mining machine body portion 12 at pivot points 40. With this arrangement the boom members 28 and 30 are pivotally connected to the mining machine body portion 12.

Upon extention and retraction of the piston rods 36 within the piston cylinder assemblies 38, the boom member 26 is operable to pivot about the pivot points 34 of the arm members 28 and 30 to move the boom member 26 vertically to the position illustrated in phantom in FIG. 2. A cutter drum assembly generally designated by the numeral 42 connected to the boom member 26 performs a shear cut of the mine face. Also the mining machine 12 is operable to advance into the mine face with the boom member 26 in the upper position, as illustrated in phantom in FIG. 2. The piston cylinder assemblies 38 are operable to pivot the boom member 26 downwardly to the position as illustrated by the solid lines in FIG. 2. In this manner the cutter drum assembly 42 dislodges solid material from the mine face by a downward shear cut.

Figure 3:
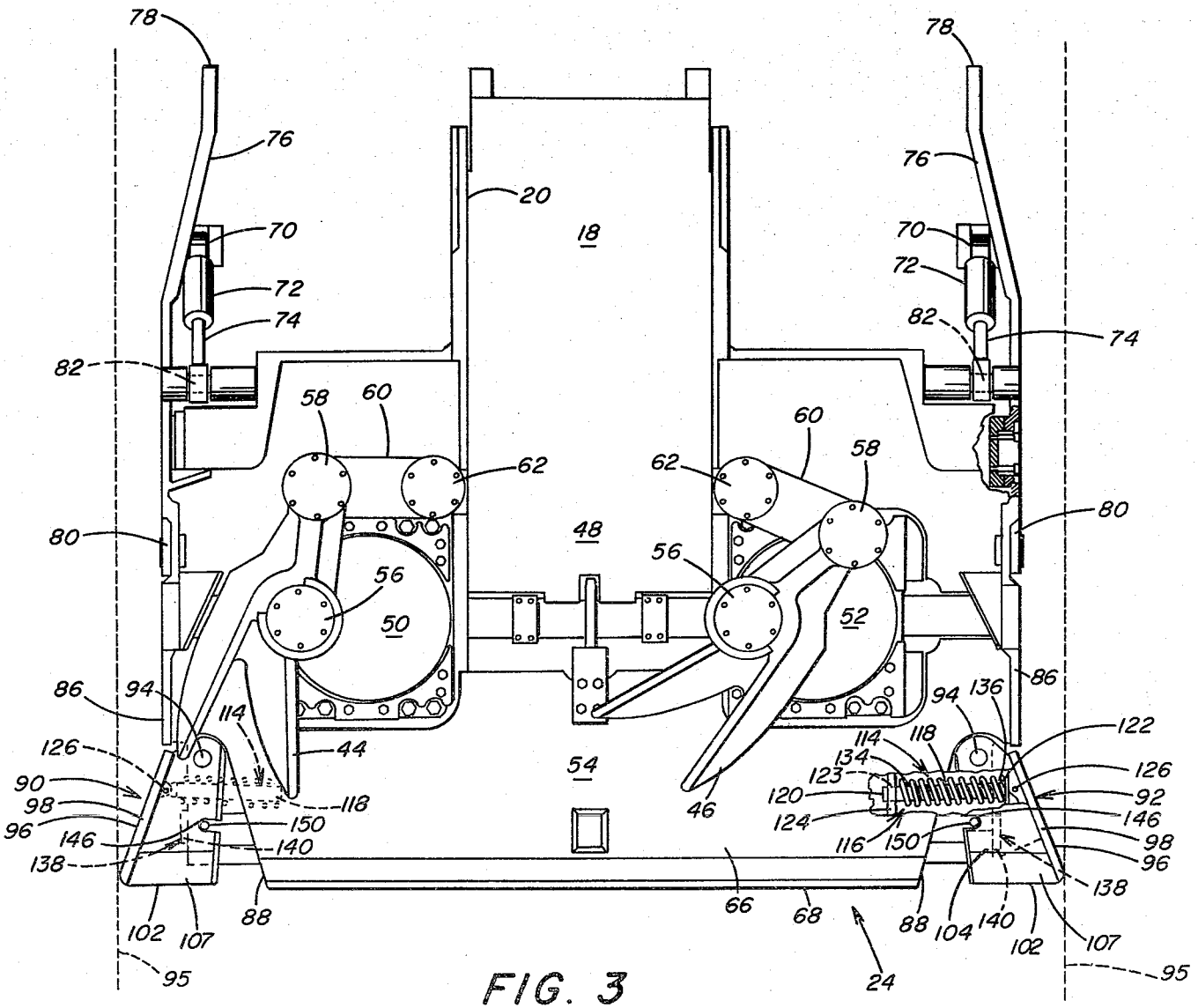
FIG. 3 is an enlarged fragmentary plan view of the gathering platform of the mining machine, illustrating a pair of side deflector plates pivotally mounted on the gathering platform and urged outwardly therefrom by springs extending between the gathering platform and the side deflector plates.

The material dislodged by the cutter drum assembly 42 is fed onto the gathering device 24 by the forward advancement of the mining machine 10. The gathering device 24, as shown in FIG. 3, includes a pair of gathering arms 44 and 46 that are mounted on opposite sides of receiving end portion 48 of the conveyor mechanism 18. The receiving end portion 48 is positioned between the gathering arms 44 and 46 and is operatively associated with the gathering device 24. The gathering arms 44 and 46 are connected to a pair of disc members 50 and 52 that are rotatably supported on a gathering platform 54 of the gathering device 24. The disc members 50 and 52 are driven in a suitable manner to transversely pivot the arm members 44 and 46 toward and away from the conveyor receiving end portion 48. The arm members 44 and 46 are connected to the rotatable disc members 50 and 52 by pins 56. The gathering arms 44 and 46 are also connected at their rearward end portions of pins 58 to link arms 60. The link arms 60 are pivotal on the gathering platform 54 about pins 62.

Figure 4:
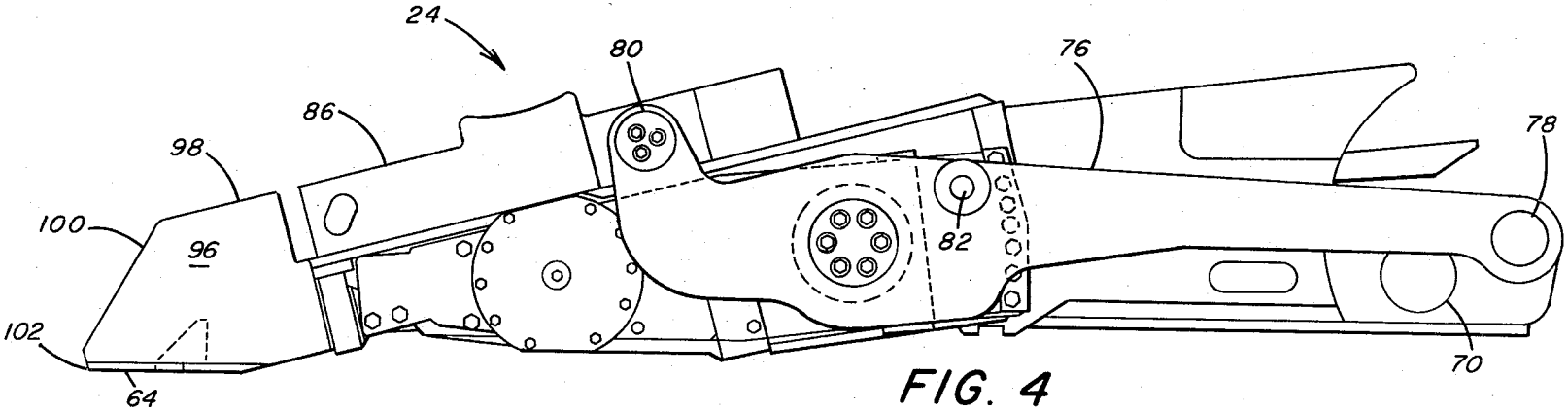
FIG. 4 is an enlarged view in side elevation of the gathering device illustrated in FIG. 3.

As illustrated in FIG. 4 in which the cutter drum assembly 42 has been removed for clarity of illustration, the gathering device 24 includes the gathering platform 54 having a ground engaging horizontal surface 64 that is arranged to advance on the mine floor and a material receiving surface 66, illustrated in FIG. 3. The material receiving surface 66 is connected to the ground engaging surface 64 to form a forward edge portion 68. The forward edge portion 68 extends transversely across the front of the mining machine 10 and is positioned rearwardly and below the cutter drum assembly 42, as illustrated in FIG. 2. The gathering platform 54 extends rearwardly of the forward transverse edge portion 68 and is pivotally connected at pivot point 70, as illustrated in FIG. 4, to the mining machine body portion 12.

A pair of piston cylinder assemblies 72 are positioned laterally of the gathering device 24 and are pivotally connected at their end portions to the machine body portion 12. As illustrated in FIG. 3 each of the piston cylinder assemblies 72 includes an extensible piston rod 74 that is connected to a gathering device support arm 76. As illustrated in FIGS. 3 and 4, each of the support arms 76 includes a first end portion 78 that is suitably adapted for pivotal connection to the machine body portion 12 and a second end portion 80 that is rigidly connected to the gathering platform 54.

The piston rods 74 are connected intermediate the end portions 78 and 80 to the support arms 76 by a transversely extending pivot pin 82. With this arrangement actuation of the piston cylinder assemblies 72 to extend and retract the piston rods 74 raises and lowers the gathering platform 54 relative to the mine floor 84. Thus when it is desired to tram the mining machine 10 from one operating location to another operating location, the ground engaging surface 64 of the gathering platform 54 can be elevated above the mine floor by pivotal movement of the gathering device 24 by the elevating force exerted upon the support arms 76 by the piston cylinder assemblies 72.

As illustrated in FIGS. 3 and 4, vertical plate members 86 extend upwardly from opposite side portions 88 of the gathering platform 54. The opposite side portions 88 extend rearwardly from the forward edge portion 68 on the gathering platform 54. The opposite side portions 88 serve to confine the loose material on the material receiving surface 66 of the gathering platform 54. In accordance with the present invention, as illustrated in FIG. 3, a pair of pivotal sideboards or side deflector plates 90 and 92 are pivotally connected to the gathering platform 54 by pivot pins 94. The sideboards 90 and 92 are positioned forwardly of the vertical plate members 86 and oppositely of the side portions 88 adjacent the forward edge portion 68.

Figure 5:
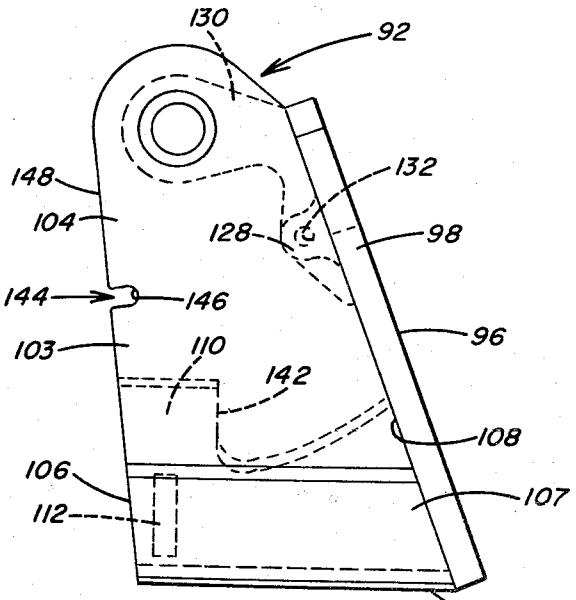
FIG. 5 is a top plan view of a side deflector plate of the present invention adapted for pivotal mounting on the gathering platform.
Figure 6:
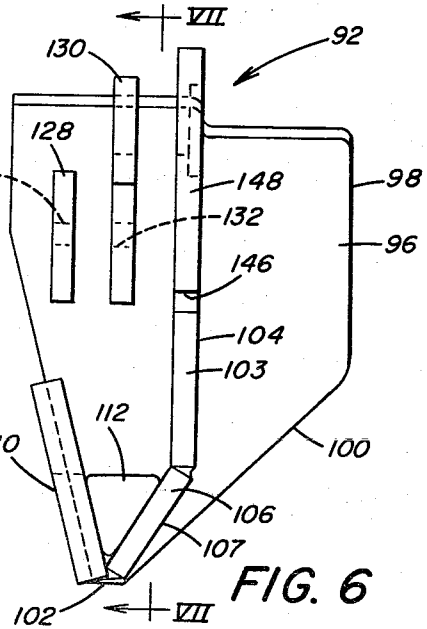
FIG. 6 is a view in side elevation of the side deflector plates shown in FIG. 5, illustrating an upstanding wall portion extending from a material receiving surface that extends rearwardly from the forward inclined surface of the side deflector plate.
Figure 7:
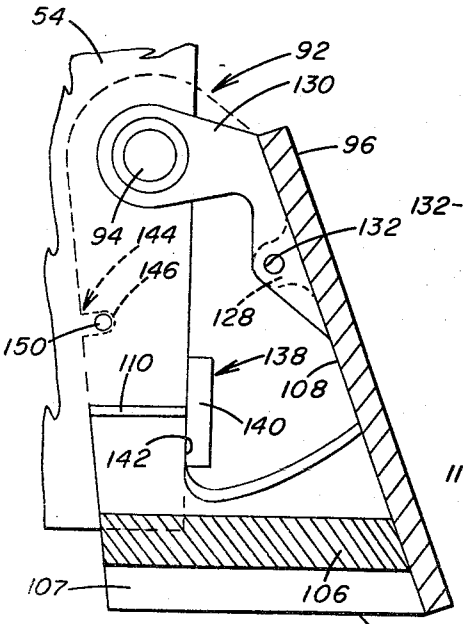
FIG. 7 is a partial sectional view of the side deflector plate taken along line VII—VII of FIG. 6, illustrating the engagement of the abutment surface of the ground engaging portion of the side deflector plate with a stop plate mounted on the gathering platform for limiting the outward pivotal movement of the side deflector plate on the gathering platform.

As shown in FIG. 3 each of the sideboards 90 and 92 has a similar configuration, and the sideboard 92 is illustrated in greater detail in FIGS. 5–7. Therefore, it should be understood that the description of the sideboard 92 is also applicable to the sideboard 90. The sideboards 90 and 92 are both operable to deflect the loose material deposited on the mine floor adjacent the forward edge portion 68 and opposite side portions 88 at the mine wall or ribs onto the gathering platform material receiving surface 66. The mine walls are schematically illustrated by the dashed lines generally designated by the numeral 95 in FIG. 3. The sideboards 90 and 92 are thus operable to deflect the loose material at the mine walls 95 onto the gathering platform 54 by being maintained in a position closely adjacent or abutting the mine walls 95 and movable relative thereto without being damaged.

Each sideboard 90 and 92 includes an upstanding wall portion 96, illustrated in FIGS. 4–6. The upstanding wall portion 96 is adapted to be positioned with the outer surface thereof positioned closely adjacent to or in abutting relation with the mine wall. The wall portion 96 includes an upper inclined surface 98 that is aligned with the upper surface of the vertical side plates 86 of the gathering platform 54, as illustrated in FIG. 4. Extending downwardly from and at an angle relative to the inclined surface 98 is a forwardly extending, inclined front end portion 100. The front end portion 100 abuts a forward transverse edge portion 102 that extends transversely across the front of each sideboard 90 and 92.

Each of the sideboards 90 and 92 includes a generally horizontal plate 103 having a material receiving surface 104 that extends laterally from the upstanding wall portion 96 toward the side portions 88 of the gathering platform 54. The material receiving surface 104 is positioned at the elevation of the material receiving surface 66 of the gathering platform 54 to provide for continuous flow of dislodged material from the surface 104 to the surface 66 and into the path of the pivoting gathering arms 44 and 46.

The forward transverse edge portion 102 of the sideboard 92 is formed by an inclined plate 106. The edge portion 102 is slidable on the mine floor. The inclined plate 106, as illustrated in FIG. 6, extends upwardly at an angle from the edge portion 102 and has a material receiving surface 107. Material receiving surface 107 merges with material receiving surface 104. The forward edge portion 102 and the material receiving surfaces 104 and 107 form a lateral edge 108 that is connected to the upstanding wall portion 96. The upstanding wall portion 96 has an upper portion that extends upwardly from the edge portion 108 and the material receiving surface 104 and a lower portion that extends downwardly from the edge portion 108 and the surface 104.

As illustrated in FIG. 6, the inclined front end portion 100 of the upstanding wall portion 96 extends rearwardly from the forward edge portion 102 to a position above the material receiving surface 104 to facilitate the flow of loose material up the inclined plate 106 onto the horizontal plate 103. Also as illustrated in FIG. 6, the sideboard 92 includes a ground engaging portion 110 that is positioned in spaced underlying relation with the plate 103. The ground engaging portion 110 is welded longitudinally to the lower portion of the upstanding wall portion 96 and transversely to the inclined plate 106 along the edge portion 102. Also, the inclined plate 106 is welded to the horizontal plate 103. The ground engaging portion 110 is thus adapted to slidably support the sideboard 92 on the mine floor. A stiffener member 112 is positioned between and in abutting relation with the inclined plate 106 and the ground engaging portion 110.

A suitable resilient device generally designated by the numeral 114, as illustrated in FIG. 3, extends between the gathering platform 54 and each of the sideboards 90 and 92 for the purpose of applying an outward force upon each of the sideboards to urge the upstanding wall portions 96 to a position to deflect the loose material located on the mine floor at the mine wall onto the material receiving surfaces 104 for movement onto the gathering platform material receiving surface 66.

The resilient devices 114 preferably are compression springs that are operable to maintain the upstanding wall portions 96 in a position closely adjacent to or abutting the mine wall 95, as illustrated in FIG. 3, to direct the material deposited on the mine floor at the mine wall onto the gathering platform 54 as the mining machine advances during the dislodging operation. During this operation the forward edge portion 68 of the gathering platfrom 54 and the forward edge portions 102 of the sideboards 90 and 92 are positioned in contact with the mine floor and are slidable thereon.

Each resilient device or compression spring 114 is supported between the gathering platform 54 and the pivotal sideboards 90 and 92 by a guide mechanism generally designated by the numeral 116 in FIG. 3. The guide mechanism 116 preferably includes a tubular or rod like member 118 having a first end portion 120 and a second end portion 122. The first end portion 120 is longitudinally, movably retained in a slot 123 of a plate member 124 that is rigidly secured to the gathering platform 54. The second end portion 122 of the rod member 118 is connected by a pin 126 to the respective sideboards 90 and 92.

The pin 126 extends through aligned bores provided in the rod member end portion 122 and in a pair of parallel spaced plate members 128 and 130. The plate members 128 and 130 are secured to and extend outwardly from the upstanding wall portion 96 below the plate 103. As illustrated in FIG. 6, each of the plate members 128 and 130 is provided with a bore 132 for receiving the pin 126 that also extends through the second end portion 122 of rod member 118. Thus in the assembled structure the rod member 118 is positioned between the spaced apart plate members 128 and 130.

The compression spring 114 is positioned around the rod member 118. The compression spring 114 includes a first end portion 134 that is retained in abutting relation with the plate member 124 and a second end portion 136 that is positioned in abutting relation with the plate members 128 and 130 of the sideboard 92. With this arrangement the compression spring 114 is maintained in a position between the gathering platform 54 and the sideboard 92 to exert an outward force upon the sideboard 92 to maintain the sideboard 92 pivoted outwardly about the vertical pivot pin 94 from the gathering platform 54. The sideboard upstanding wall portions 96 are thus positioned in abutting relation with the mine wall to direct the loose material at the mine wall from the mine floor onto the material receiving surfaces 104 and 107.

The outward force exerted upon the sideboard 92 by the compression spring 114 longitudinally moves the rod member 118 outwardly in the slot 123. Therefore, the upstanding wall portion 96 and particularly the outer surface of the inclined front end portion 100 thereof is urged into contact with the mine wall and is operable due to the compressive nature of spring 114 to follow the contour of the mine wall. The sideboard 92 is freely pivotal about the pivot pin 94 to permit the sideboard 92 to remain in contact with the mine wall but move in response to the undulating contour or roughness of the mine wall. This prevents the sideboard 92 from being jammed against the mine wall and from becoming bent or otherwise damaged as the sideboard 92 moves relative to the mine wall as the mining machine 10 advances.

Thus, with the present invention if the walls should abruptly converge inwardly, then the upstanding wall portion 96 is not jammed against the mine wall but is free to pivot inwardly toward the gathering platform 54 by compression of the spring 114. It will be apparent that the spring 114 has a spring constant which permits the spring to retract or be compressed by a force of a magnitude less than a force which would cause the sideboard to bend before the spring would compress. In this manner the sideboard 92 can be maintained in a position against the mine wall as the mining machine advances but is not damaged.

If the mine wall should abruptly diverge outwardly, then the compression spring 114 urges the sideboard 92 to pivot outwardly so that the upstanding wall portion 96 is maintained in contact with the mine wall and movable relative thereto. In this manner the sideboard follows the contour of the mine wall. If the contour should be irregular, then the upstanding wall portion 96 will not be jammed against the mine wall and subsequently broken but will be free to pivot inwardly and outwardly by operation of the spring member 114.

The sideboards 90 and 92 are pivotal relative to the gathering platform 54 between a retracted position where the spring member 114 is compressed and a fully extended position, as illustrated in FIG. 3, where the spring member 114 is uncompressed. In the uncompressed state of the spring member 114, the spring member 114 extends to its free length. The sideboard 92 is pivoted to a maximum extended position for gathering up loose material on the mine floor. To limit the outward pivotal movement of the sideboard 92 when the compression spring 114 reaches its free length, a stop device generally designated by the numeral 138 in FIGS. 3 and 7 is secured to the gathering platform 54 and is engagable with the sideboards 90 and 92.

The stop device 138 is operable to limit the outward pivotal movement of the sideboards 90 and 92 on the gathering platform 54 to a maximum outwardly pivoted position for gathering up loose material on the mine floor at the mine wall. Preferably the stop device includes a stop plate 140 that is secured, such as by welding, to the gathering platform opposite side portions 88 adjacent the forward edge portion 68. The ground engaging portion 110 of each sideboard 90 and 92 is operable to abut the stop plate 140 when the sideboards are in the maximum outwardly pivoted position on the gathering platform 54. As illustrated in FIGS. 5 and 7 the ground engaging portion 110 has a hook-like configuration that extends laterally from the upstanding wall portion 96 and rearwardly from the transverse forward edge portion 102.

The ground engaging portion 110 has an abutment surface 142 that is positioned oppositely of the stop plate 140. The stop plate 140 is arranged to extend upwardly past the abutment surface 142 into the space provided between the ground engaging portion 110 and the horizontal plate 103. In the maximum outwardly pivoted position of each sideboard 90 and 92, the compression spring 114 is extended to its free length at which point the abutment surface 142 is moved into abutting relation with the stop plate 140. Thus, the sideboards 90 and 92 are freely pivotal on the gathering platform 54 between a retracted position and a fully extended position.

In the retracted position compressive forces are exerted on the spring member 114 to compress the spring to a length less than its free length. In the fully extended position the compressive forces are removed from the spring member 114. The spring member 114 is operable to extend to its free length. When the spring member 114 is fully extended the stop plate 140 restrains the sideboard from further outward pivotal movement by contact of the abutment surface 142 of the ground engaging portion 110 with the stop plate 140 as the sideboard 92 pivots outwardly toward the mine wall. Thus when the mining machine is moved to a position in the mine removed from close adjacency with the mine walls permitting the spring members 114 to extend to their free or unloaded length further outward pivotal movement of the sideboards 90 and 92 is restrained. In this manner the pivotal sideboards 90 and 92 are stabilized but are free to pivot inwardly when the mining machine moves the sideboards 90 and 92 against an obstruction. In this manner damage to the sideboards 90 and 92 is prevented.

Further in accordance with the present invention a position indicator generally designated by the numeral 144 in FIG. 7 is provided on the gathering platform 54 and on each of the sideboards 90 and 92 for indicating whether the spring member 114 is in a compressed state or an uncompressed state. This feature facilitates disassembly of the sideboards 90 and 92 from the gathering platform 54. Preferably for the safety of the personnel who disassemble the sideboards 90 and 92, each spring member 114 should be in a fully extended position so that a compressive load is not applied to the respective spring member 114. Then when the pivot pin 94 is removed from the aligned bores of the sideboards 90, 92 and the gathering platform 54 to free the sideboards 90 and 92, the respective spring members 114 will not abruptly extend. This prevents the sudden expansion of compressed spring members 114 to their free length when the sideboards 90 and 92 are removed. Thus possible injury to operating personnel and/or damage to the sideboards 90 and 92 is averted.

The position indicator 144 includes a slot or recess 146 in each sideboard lateral edge portion 148 and an aperture 150 in the gathering platform 54. The aperture 150 is positioned in underlying relation with each sideboard 90 and 92. The slot 146 and aperture 150 associated with the sideboard 90 is illustrated in FIG. 3, and the slot 146 and aperture 150 associated with the sideboard 92 is illustrated in FIG. 7. The slot 146 for sideboard 92 is also shown in FIGS. 5 and 6.

As illustrated, for example in FIG. 7, when the abutment surface 142 of ground engaging portion 110 abuts stop plate 140, aperture 150 is visible through the slot 146. In this maximum outward pivoted position of the respective sideboard 90 and 92 on the gathering platform 54 the spring member 114 is fully extended. The overlying relation of slot 146 and aperture 150 indicates that the spring member 114 is not in a compressed state. The spring member 114 is thus unloaded, and therefore the respective sideboard 90 and 92 is in the preferred safe position for disassembly from gathering platform 54.

Accordingly, if the aperture 150 in the gathering platform 54 is not visible through the slot 146, the spring member 114 is in the compressed state in which case compressive loads remain applied to the spring member 114. Therefore, in order to safely remove the respective sideboard 90, 92 the sideboard must be positioned to permit pivotal movement of the sideboard to release the compressive loads from the spring member 114. Thus when the respective sideboard 90 and 92 further pivots outwardly and aperture 150 becomes visible through slot 146, then operating personnel can be assured all compressive loads have been released from the spring member 114.

According to the provisions of the Patent Statutes, I have explained the principle, preferred construction and mode of operation of our invention and have illustrated and described what I now consider to represent its best embodiments. However, it should be understood that, within the scope of the appended claims, the invention may be practiced otherwise than as specifically illustrated and described.

I claim:

1. A material gathering device for a mining machine comprising, a gathering platform extending forwardly from said mining machine for slidable engagement with the mine floor, said gathering platform having a forward edge portion and opposite side portions extending rearwardly from said forward edge portion, deflector means for deflecting loose material deposited on the mine floor adjacent said forward edge portion and said opposite side portions onto said gathering platform, means for pivotally mounting said deflector means on said gathering platform adjacent said opposite side portions, said deflector means having an upstanding wall portion adapted to be positioned closely adjacent the mine wall and a material receiving surface extending from said upstanding wall portion toward said respective opposite side portion of said gathering platform, resilient means extending between said gathering platform and said deflector means for urging said delector means upstanding wall portion to a position to deflect the loose material located on the mine floor at the mine wall onto said material receiving surface for movement therefrom onto said gathering platform, said resilient means being freely movable between a compressed length and an uncompressed, free length to permit pivotal movement of said deflector means between a retracted position and an extended position relative to said gathering platform side portions, a stop plate secured to each of said gathering platform side portions, said deflector means including a portion overlying and movable relative to said gathering platform, said deflector means portion having an abutment surface positioned oppositely of said respective stop plate so that upon pivotal movement of said deflector means said abutment surface is movable into and out of abutting contact with said stop plate, and said deflector means being restrained from outward pivotal movement when said resilient means extends to said uncompressed, free length by abutting contact of said abutment surface with said stop plate.

2. A material gathering device for a mining machine as set forth in claim 1 which includes, said resilient means having a first end portion abutting said gathering platform, said gathering platform being maintained in a fixed position abutting said resilient means first end portion, said resilient means having a second end portion maintained in abutting relation with said pivotal deflector means, and said resilient means being placed in a compressed state between said fixed gathering platform and said pivotal deflector means to urge said deflector means to pivot outwardly on said gathering platform and maintain said upstanding wall portion in contact with the mine wall for gathering up loose material on the mine floor along the mine wall.

3. A material gathering device for a mining machine as set forth in claim 1 which includes, said resilient means having a first end portion and a second end portion, said first end portion being maintained in a fixed position abutting said gathering platform and said second end portion abutting said deflector means, and said resilient means being operable to extend and retract between said gathering platform and said deflector means and maintain an outward force on said deflector means to position said upstanding wall portion closely adjacent the mine wall for directing loose material deposited on the mine floor adjacent the mine wall onto said material receiving surface.

4. A material gathering device for a mining machine was set forth in claim 1 which includes, said deflector means having a forward transverse edge portion and an inclined surface extending upwardly from said forward transverse edge portion to said material receiving surface, said forward transverse edge portion extending laterally of and being aligned with said gathering platform forward edge portion, and said upstanding wall portion being connected laterally to and extending rearwardly from said forward transverse edge portion and said inclined surface so that the loose material is directed by said upstanding wall portion to flow up said inclined surface and rearwardly onto said material receiving surface.

5. A material gathering device for a mining machine as set forth in claim 1 which includes, said deflector means having a forward transverse edge portion positioned for slidable movement on the mine floor, an inclined surface extending upwardly at an angle from said forward transverse edge portion to said material receiving surface, said forward transverse edge portion and said material receiving surface having a lateral edge portion arranged to be positioned adjacent the mine wall, said upstanding wall portion being connected to and extending upwardly from said lateral edge portion of said forward transverse edge portion and said material receiving surface, and said upstanding wall portion having an inclined front end portion extending rearwardly from said forward transverse edge portion to a position above said material receiving surface to facilitate the flow of loose material up said inclined surface onto said material receiving surface.

6. A material gathering device for a mining machine as set forth in claim 1 which includes, said deflector means having a ground engaging portion positioned in spaced underlying relation with said material receiving surface, said ground engaging portion adapted to slidably support said deflector means on the mine floor, said ground engaging portion including said abutment surface positioned oppositely of said stop plate, said stop plate extending upwardly past said abutment surface into the space between said ground engaging portion and said material receiving surface, and said abutment surface being movable into and out of abutting relation with said stop plate to permit said deflector means to pivot freely between a retracted position and an extended position.

7. A material gathering device for a mining machine as set forth in claim 1 in which, said means for pivotally mounting said deflector means on said gathering platform includes a pin member extending through said deflector means material receiving surface and said gathering platform, and said pin member being releasably engagable with said deflector means and said gathering platform to permit said deflector means to be removed from connection to said gathering platform.

8. A material gathering device for a mining machine as set forth in claim 1 which includes, guide means for supporting said resilient means between said gathering platform and said deflector means, said guide means having a first end portion movably positioned on said gathering platform and a second end portion connected to said deflector means, and said resilient means having a first end portion abutting said gathering platform and a second end portion exerting an outward force upon said deflector means to maintain said deflector means pivoted outwardly from said gathering platform with said deflector means upstanding wall portion positioned for directing loose material at the mine wall from the mine floor on to said material receiving surface.

9. A material gathering device for a mining machine as set forth in claim 1 which includes, said resilient means being movable between an extended position and a retracted position between said gathering platform and said deflector means, said resilient means being in a compressed state when in the restracted position, said resilient means being in an uncompressed state in the extended position, and position indicator means provided on said gathering platform and said deflector means for indicating whether said resilient means is in a compressed state or an uncompressed state.

* * * * *